US007851418B2

(12) United States Patent
Habeeb et al.

(10) Patent No.: US 7,851,418 B2
(45) **Date of Patent: *Dec. 14, 2010**

(54) ASHLESS DETERGENTS AND FORMULATED LUBRICATING OIL CONTAINING SAME

(75) Inventors: Jacob Joseph Habeeb, Westfield, NJ (US); William H. Buck, West Chester, PA (US); Douglas Edward Deckman, Mullica Hill, NJ (US); William L. Maxwell, Pilesgrove, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 865 days.

This patent is subject to a terminal disclaimer.

(21) Appl. No.: 11/444,773

(22) Filed: Jun. 1, 2006

(65) Prior Publication Data

US 2006/0276350 A1 Dec. 7, 2006

Related U.S. Application Data

(60) Provisional application No. 60/687,105, filed on Jun. 3, 2005.

(51) Int. Cl.
*C10M 129/50* (2006.01)
*C10M 135/36* (2006.01)
*C10M 125/26* (2006.01)

(52) U.S. Cl. ..... 508/195; 508/192; 508/196; 508/197

(58) Field of Classification Search ..... 508/192, 508/195, 196, 197
See application file for complete search history.

(56) References Cited

U.S. PATENT DOCUMENTS

| | | | | |
|---|---|---|---|---|
| 2,582,733 | A * | 1/1952 | Zimmer et al. | 106/14.27 |
| 2,758,086 | A | 8/1956 | Stuart et al. | |
| 2,862,883 | A | 12/1958 | Hughes et at | |
| 3,224,957 | A | 12/1965 | Kent | 208/48 |
| 3,267,033 | A | 8/1966 | Allen | 252/32.7 |
| 3,694,247 | A * | 9/1972 | Desjarlais et al. | 430/157 |
| 3,969,234 | A | 7/1976 | Schiff | |
| 4,079,012 | A | 3/1978 | Bosniack | 252/33.4 |
| 4,617,137 | A | 10/1986 | Plavac | 252/49.6 |
| 4,758,363 | A * | 7/1988 | Sung et al. | 508/229 |
| 4,761,482 | A | 8/1988 | Karol | 548/142 |
| 4,849,118 | A | 7/1989 | Stauffer et al. | 252/47 |
| 4,904,403 | A | 2/1990 | Karol | 252/47.5 |
| 5,026,865 | A | 6/1991 | Karol | 548/142 |
| 5,055,584 | A | 10/1991 | Karol | 548/142 |
| 5,076,945 | A | 12/1991 | Habeeb et al. | 252/47.5 |
| 5,108,462 | A | 4/1992 | Habeeb et al. | 44/383 |
| 5,138,065 | A | 8/1992 | Karol | 548/142 |
| 5,171,861 | A * | 12/1992 | Ernhoffer et al. | 508/231 |
| 5,177,212 | A | 1/1993 | Karol et al. | 548/142 |
| 5,194,621 | A | 3/1993 | Karol et al. | 548/142 |
| 5,205,945 | A | 4/1993 | Cardis et al. | |
| 5,268,114 | A | 12/1993 | Odorisio et al. | 252/51.5 |
| 5,320,767 | A | 6/1994 | Habeeb | |
| 5,330,666 | A * | 7/1994 | Habeeb | 508/518 |
| 5,391,756 | A | 2/1995 | Karol et al. | 598/112 |
| 5,597,785 | A | 1/1997 | Karol | 508/274 |
| 5,849,925 | A | 12/1998 | Karol et al. | 548/142 |
| 6,218,412 | B1 * | 4/2001 | Thorwart et al. | 514/361 |
| 6,365,557 | B1 | 4/2002 | Karol et al. | 508/274 |
| 6,482,772 | B1 | 11/2002 | Bratz et al. | |
| 6,482,777 | B2 | 11/2002 | Cain | |
| 6,605,572 | B2 | 8/2003 | Carrick et al. | |
| 6,620,771 | B2 | 9/2003 | Karol et al. | 508/274 |
| 6,713,438 | B1 | 3/2004 | Baillargeon et al. | |
| 2004/0171500 | A1 | 9/2004 | Morita | 508/192 |
| 2005/0172543 | A1 * | 8/2005 | Muir | 44/314 |
| 2007/0154128 | A1 * | 7/2007 | Mikami | 384/627 |
| 2007/0179066 | A1 * | 8/2007 | Sakamoto et al. | 508/113 |
| 2007/0191240 | A1 * | 8/2007 | Suda | 508/485 |

FOREIGN PATENT DOCUMENTS

| | | | |
|---|---|---|---|
| EP | 0 535 470 | B1 | 11/1997 |
| EP | 0 574 655 | B1 | 4/1998 |
| GB | 1199422 | | 7/1970 |
| GB | 2 235 695 | A | 3/1991 |
| JP | 04198396 | A | 7/1992 |
| JP | 0 394 468 | B1 | 12/1993 |
| JP | 2613117 | | 2/1997 |
| JP | 2002188091 | A | 7/2002 |
| WO | WO 96/38518 | | 12/1996 |

OTHER PUBLICATIONS

Yang, Y., Pan, S., Hou, X., Guo, Jin., Li, F., Han, J., Guo, Jix., Jia, D., Inorg. Chim. Acta, 2010, Accepted Manuscript, doi: doi:10.1016/j.ica.2010.06.010.*

* cited by examiner

*Primary Examiner*—Glenn Caldarola
*Assistant Examiner*—Jim Goloboy

(57) ABSTRACT

The present invention is directed to ashless detergents comprising the products resulting from the reaction of a salicylic acid, organic group substituted salicylic acid, sulfonic acid or organic groups substituted sulfur acid with thiadiazole or organic group substituted thiadiazole or an alkyl primary or secondary amine, and to formulated lubricating oils containing said ashless detergents.

27 Claims, No Drawings

ASHLESS DETERGENTS AND FORMULATED LUBRICATING OIL CONTAINING SAME

This application claims the benefit of U.S. Ser. No. 60/687, 105 filed Jun. 3, 2005.

FIELD OF THE INVENTION

The present invention relates to detergents and lubricating oil formulation containing detergent.

DESCRIPTION OF THE RELATED ART

Lubricating oil technology currently employs alkaline and alkaline earth metal sulfonates, salicylates, and phenates as detergents and as a means for maintaining the total base number of the lubricant so as to counteract acidity and acid buildup in lubricating oil, especially engine oil during use.

These detergents however are a source of ash in the lube oil.

In the coming years more stringent limitation on particulate matter (PM) emissions from diesel engine, especially diesel powered vehicles are scheduled to go into effect in most of the major markets. Vehicle manufactures will likely be required to utilize diesel particulate filter (DPF) technology as part of their exhaust after treatment strategy to mitigate/control particulate matter emissions. Other emission regulations will also stipulate the duration or mileage for which a vehicle manufacturer must guarantee adequate performance of after treatment devices such as diesel particulate filters.

The solid, nonvolatile ash in the lube oil contributed by the metal sulfonate, salicylate, or phenate detergents, as well as by the zinc containing antiwear agents in the lube oil, becomes a major constituent of particulate matter emitted from a diesel engine.

Control of this ash by specifying limits on the chemicals which are the potential ash-causing components on the engine oil formulations is one approach which can be followed, but limiting the amount of such chemicals which can be in the oil so as to reduce ash also limits the effectiveness of those chemicals for their intended purpose of detergency and/or total base number maintenance in the formulated oil.

Another way must be found to control the sulfated ash of the lubricant attributable to the detergents while not losing the necessary and beneficial functions of the detergent additives.

DESCRIPTION OF THE INVENTION

A new class of detergents has been discovered which are of no or very low ash insofar as they are not metal detergents, the new ashless detergents being the products of sulfonic acid, (organic group substituted) sulfonic acid, salicylic acid or (organic group substituted) salicylic acid reacted with thiadiazole, (organic group substituted) thiadiazole, or primary or secondary amines and their borated derivatives. Also disclosed are formulated lubricating oil compositions containing these new ashless detergents. The ashless detergents disclosed herein can be utilized in amounts ranging from about 0.01 to about 8.0 wt %, preferably about 0.2 to about 3.0 wt %, more preferably about 0.5 to about 2.0 wt % detergent (as active ingredient) based on the total weight of the formulated lubricating oil. These detergents function in base oils comprising Group I, Group II, Group III (e.g., GTL or other wax isomerate), Group IV, Group V, and mixtures thereof.

DETAILED DESCRIPTION OF THE INVENTION

The new ashless detergents are generally described as (organic group substituted) amine sulfonate salts and amides, (organic group substituted) amine salicylate salts and amides, (organic group substituted) thiadiazole sulfonate salts and reaction products, and (organic group substituted) thiodiazole salicylate salts and reaction products.

As used herein and in the claims, the term "organic", "organic group" or "organic radical" refers to a group or radical attached to the remainder of the molecule through a carbon atom and made up of carbon and hydrogen and optionally heteroatoms selected from one or more of nitrogen, sulfur and oxygen, said heteroatoms when present being present as skeletal atoms and/or in substitutent group(s).

Organic group or radical includes: groups or radicals composed exclusively of carbon and hydrogen and include aliphatic groups or radicals which embrace linear and branched alkyl and linear and branched alkenyl groups or radicals, cycloaliphatic groups or radicals which embrace cycloalkyl and cycloalkenyl groups or radicals, aromatic groups or radicals, including mono cyclic, fused polycyclic, spiro compounds and multi cyclic compounds wherein individual cycles or polycycles are attached to each other through alkylene or hetero atom bridges, aromatic groups or radicals substituted with aliphatic or cycloaliphatic groups or radicals, and aliphatic or cycloaliphatic groups or radicals substituted with aromatic groups or radicals, as well as cyclo groups formed when the ring is completed through different portions of the molecule attaching together to form the cyclo group; groups or radicals composed of carbon, hydrogen and one or more than one of the same or different heteroatoms (nitrogen, sulfur, oxygen) wherein the heteroatoms are present as skeletal elements in the carbon and hydrogen containing chain or ring; groups or radicals composed of carbon, hydrogen and one or more than one of the same or different heteroatoms (nitrogen, sulfur, oxygen) as substituent group on the carbon and hydrogen containing chain or ring of carbon, hydrogen and heteroatom containing chain or ring, said heteroatom substituent groups including by way of non-limiting example hydroxy, alkoxy, ether, ester, carboxyl, mercapto, mercaptal, amino, nitro, nitroso, sulfoxy and other groups.

The organic group or radical is preferably composed entirely of carbon and hydrogen, more preferably it is an aliphatic, cyclo aliphatic, or aromatic group or still more preferably an aliphatic group or radical, most preferably an alkyl group or radical.

The salicylic acids, amines, thiadiazoles and sulfonic acids are represented by the following non-limiting formula:

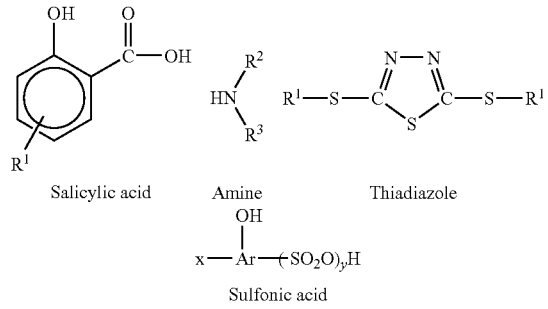

wherein $R^1$ is hydrogen or a $C_1$-$C_{40}$ alkyl, $C_2$-$C_{40}$ alkenyl, $C_6$-$C_{40}$ cycloalkyl, arylalkyl, alkylaryl, aryl, heteroatom (oxygen, and/or sulfur and/or nitrogen) substituted $C_1$-$C_{40}$ alkyl, $C_2$-$C_{40}$ alkenyl, $C_6$-$C_{40}$ cycloalkyl, aryl, arylalkyl, alkylaryl, preferably hydrogen, $C_{10}$-$C_{30}$ alkyl, alkenyl, cycloalkyl, aryl, arylalkyl, alkyl aryl and heteroatom substituted derivative thereof, most preferably hydrogen, $C_{15}$-$C_{20}$ alkyl, alkenyl, cycloalkyl, aryl, arylalkyl, alkylaryl and heteroatom substituted derivatives thereof (derivatives thereof including heteroatom substituents in the carbon backbone and heteroatom group containing substitutent(s) attached onto the carbon backbone);

$R^2$ and $R^3$ are the same or different and are hydrogen, $C_1$-$C_{20}$ alkyl, $C_2$-$C_{20}$ alkenyl, $C_6$-$C_{20}$ cycloalkyl, aryl, arylalkyl, alkyl aryl and heteroatom substitutent derivatives thereof provided that $R^2$ and $R^3$ cannot both be hydrogen, preferably $R^2$ and $R^3$ are the same or different and are hydrogen, $C_4$-$C_{20}$ tertiary alkyl group, again provided that $R^2$ and $R^3$ cannot both be hydrogen, more preferably

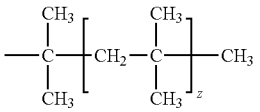

wherein z is 1 to 4, preferably 2;

x is hydrogen, $C_1$-$C_{10}$ alkyl, $C_2$-$C_{10}$ alkenyl, $C_6$-$C_{10}$ cycloalkyl, aryl, alkylaryl, arylalkyl, and hydrocarbyl substituted derivatives thereof, $NH_2$, OH, preferably hydrogen, $C_6$-$C_{10}$ alkyl;

Ar is phenyl, naphthyl, anthacenyl, preferably phenyl or naphthyl, most preferably naphthyl;

y is 1 or 2, preferably 1, and their borated derivatives.

Any thiadiazole or derivatives thereof is suitable for use as a starting material reactant to be reacted with the salicylic acid or sulfonic acid. Thiadiazoles and derivatives thereof are extensively recited in the literature, see: U.S. Pat. No. 4,617,137; U.S. Pat. No. 4,761,482; U.S. Pat. No. 5,055,584; U.S. Pat. No. 4,904,403; U.S. Pat. No. 5,026,865; U.S. Pat. No. 5,138,065; U.S. Pat. No. 5,194,621; U.S. Pat. No. 5,177,212; EP 535470 A; EP 574655 B1; U.S. Pat. No. 5,391,756; U.S. Pat. No. 5,597,785; U.S. Pat. No. 5,849,925; U.S. Pat. No. 6,365,557; U.S. Pat. No. 6,620,771; the disclosures of which are hereby incorporated by reference.

A preferred example of a useable thiadiazole is

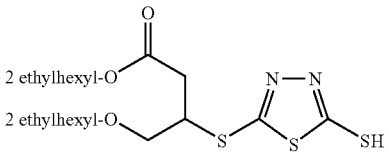

It has been discovered that the ashless detergents and their borated derivatives reduce deposit formation, contribute to the maintenance of the total acid numbers of the oils to which they are added, reduce wear, promote hydroperoxide decomposition and perform well in the thin film oxidation test, all indications that they are good detergents.

The ashless detergents can be utilized in place of all or part of the conventional alkali or alkaline earth metal detergents currently used, preferably a total replacement for such conventional detergents in formulated oils.

The lube oil formulations to which they are added comprise any natural, synthetic or unconventional base oil of lubricating oil viscosity typically used to produce formulated lubricating oil.

A preferred fully formulated lubricant of the invention is prepared by blending or admixing with the base stock an additive package comprising an effective amount of at least one ashless detergent, along with at least one additional performance enhancing additive, such as for example but not limited to at least one of a detergent, and/or a dispersant, and/or an antioxidant, and/or a pour point depressant, and/or a VI improver, and/or anti-wear agent, and/or extreme pressure additives, and/or a friction modifier, and/or a demulsifier, and/or an antifoamant, and/or antiseizure agent, and/or a corrosion inhibitor, and/or lubricity agent, and/or a seal swell control additive, and/or dye, and/or metal deactivators, and/or antistaining agent. Of these, in addition to the ashless detergent additive, those additives common to most formulated lubricating oils include optionally an additional detergent, as well as a dispersant, an antioxidant, an antiwear additive and a VI improver, with other additives being optional depending on the intended use of the oil. An effective amount of at least one ashless detergent additive and typically one or more additives, or an additive package containing at least one ashless detergent additive and one or more such additives, is added to, blended into or admixed with the base stock to meet one or more formulated product specifications, such as those relating to a lube oil for diesel engines, internal combustion engines, automatic transmissions, turbine or jet, hydraulic oil, industrial oil, etc., as is known. For a review of many commonly used additives see: Klamann in "Lubricants and Related Products" Verlog Chemie, Deerfield Beach, Fla.: ISBN 0-89573-177-0 which also has a good discussion of a number of the lubricant additives identified above. Reference is also made to "Lubricant Additives" by M. W. Ronney, published by Noyes Data Corporation, Parkridge, N.J. (1973). Various manufacturers sell such additive packages for adding to a base stock or to a blend of base stocks to form fully formulated lube oils for meeting performance specifications required for different applications or intended uses, and the exact identity of the various additives present in an additive pack is typically maintained as a trade secret by the manufacturer. However, the chemical nature of the various additives is known to those skilled in the art. For example, alkali metal sulfonates, salicylates, and phenates are well known detergents, which may be used in addition to the ashless detergent while PIBSA (polyisobutylene succinic anhydride) and PIBSA-PAM (polyisobutylene succinic anhydride amine) with or without being borated are well known and used dispersants. VI improvers and pour point depressants include acrylic polymers and copolymers such as polymethacrylates, polyalkylmethacrylates, as well as olefin copolymers, copolymers of vinyl acetate and ethylene, dialkyl fumarate and vinyl acetate, and others which are known. Friction modifiers include glycol esters and ether amines. Benzotriazole is a widely used corrosion inhibitor, while silicones are well known antifoamants. Antioxidants include hindered phenols and hindered aromatic amines such as 2,6-di-tert-butyl-4-n-butyl phenol and diphenyl amine, with copper compounds such as copper oleates and copper-PIBSA being well known. Antiwear additives include metal phosphate, metal dithiophosphate, metal dialkyl dithiophosphate, metal thiocarbamates, metal dithiocarbamates, metal dialkyl dithiocarbamates and ashless antiwear additives exemplified by ethoxylated amine dialkyldithiophosphates and ethoxylated amine dithiobenzoates as described in U.S. Pat. No. 6,165,949. Nonionic ashless antiwear additives as described in copending application U.S. No. 60/637,794 filed Dec. 21, 2004, can also be used and they include thiosalicylic acid, organic group substituted thiosalicylic acid, organic esters of thiosalicylic acid, organic esters of organic group substituted thiosalicylic acid, thioromalonate, 2,2 dithiodipyridine, organic group substituted 2,2 dithiodipyridene, thiazolidine and organic group substituted thiazolidine.

The use of the ashless additives and particularly the ashless detergent additives is especially preferred for use in lubricating oils intended for low/reduced or no ash (ashless) applications.

This is meant to be an illustrative, but nonlimiting list of the various additives used in lube oils. Thus, additive packages can and often do contain many different chemical types of additives. All of these additives are known and illustrative examples may be found, for example, in U.S. Pat. Nos. 5,352,374; 5,631,212; 4,764,294; 5,531,911 and 5,512,189.

A wide range of lubricating base oils is known in the art. Lubricating base oils that are useful in the present invention are natural oils, synthetic oils, and unconventional oils. Natural oil, synthetic oils, and unconventional oils and mixtures thereof can be used unrefined, refined, or rerefined (the latter is also known as reclaimed or reprocessed oil). Unrefined oils are those obtained directly from a natural, synthetic or unconventional source and used without further purification. These include for example shale oil obtained directly from retorting operations, petroleum oil obtained directly from primary distillation, and ester oil obtained directly from an esterification process. Refined oils are similar to the oils discussed for unrefined oils except refined oils are subjected to one or more purification or transformation steps to improve at least one lubricating oil property. One skilled in the art is familiar with many purification or transformation processes. These processes include, for example, solvent extraction, secondary distillation, acid extraction, base extraction, filtration, percolation, hydrogenation, hydrorefining, and hydrofinishing. Rerefined oils are obtained by processes analogous to refined oils, but use an oil that has been previously used.

Groups I, II, III, IV and V are broad categories of base oil stocks developed and defined by the American Petroleum Institute (API Publication 1509; www.API.org) to create guidelines for lubricant base oils. Group I base stocks generally have a viscosity index of between about 80 to 120 and contain greater than about 0.03% sulfur and less than about 90% saturates. Group II base stocks generally have a viscosity index of between about 80 to 120, and contain less than or equal to about 0.03% sulfur and greater than or equal to about 90% saturates. Group III stock generally has a viscosity index greater than about 120 and contains less than or equal to about 0.03% sulfur and greater than about 90% saturates. Group IV includes polyalphaolefins (PAO). Group V base stocks include base stocks not included in Groups I-IV. Table A summarizes properties of each of these five groups.

TABLE A

| Base Stock Properties | | | |
|---|---|---|---|
| | Saturates | Sulfur | Viscosity Index |
| Group I | <90% and/or | >0.03% and | ≧80 and <120 |
| Group II | ≧90% and | ≦0.03% and | ≧80 and <120 |
| Group III | ≧90% and | ≦0.03% and | ≧120 |
| Group IV | Polyalphaolefins (PAO) | | |
| Group V | All other base oil stocks not included in Groups I, II, III, or IV | | |

Natural oils include animal oils, vegetable oils (castor oil and lard oil, for example), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful in the present invention. Natural oils vary also as to the method used for their production and purification, for example, their distillation range and whether they are straight run or cracked, hydrorefined, or solvent extracted.

Synthetic oils include hydrocarbon oils as well as non hydrocarbon oils. Synthetic oils can be derived from processes such as chemical combination (for example, polymerization, oligomerization, condensation, alkylation, acylation, etc.), where materials consisting of smaller, simpler molecular species are built up (i.e., synthesized) into materials consisting of larger, more complex molecular species. Synthetic oils include hydrocarbon oils such as polymerized and interpolymerized olefins (polybutylenes, polypropylenes, propylene isobutylene copolymers, ethylene-olefin copolymers, and ethylene-alphaolefin copolymers, for example). Polyalphaolefin (PAO) oil base stock is a commonly used synthetic hydrocarbon oil. By way of example, PAOs derived from $C_8$, $C_{10}$, $C_{12}$, $C_{14}$ olefins or mixtures thereof may be utilized. See U.S. Pat. Nos. 4,956,122; 4,827,064; and 4,827,073, which are incorporated herein by reference in their entirety.

The number average molecular weights of the PAOs, which are known materials and generally available on a major commercial scale from suppliers such as ExxonMobil Chemical Company, Chevron, BP-Amoco, and others, typically vary from about 250 to about 3000, or higher, and PAOs may be made in viscosities up to about 100 cSt (100° C.), or higher. In addition, higher viscosity PAOs are commercially available, and may be made in viscosities up to about 3000 cSt (100° C.), or higher. The PAOs are typically comprised of relatively low molecular weight hydrogenated polymers or oligomers of alphaolefins which include, but are not limited to, about $C_2$ to about $C_{32}$ alphaolefins with about $C_8$ to about $C_{16}$ alphaolefins, such as 1-octene, 1-decene, 1-dodecene and the like, being preferred. The preferred polyalphaolefins are poly-1-octene, poly-1-decene and poly-1-dodecene and mixtures thereof and mixed olefin-derived polyolefins. However, the dimers of higher olefins in the range of about $C_{14}$ to $C_{18}$ may be used to provide low viscosity base stocks of acceptably low volatility. Depending on the viscosity grade and the starting oligomer, the PAOs may be predominantly trimers and tetramers of the starting olefins, with minor amounts of the higher oligomers, having a viscosity range of about 1.5 to 12 cSt.

PAO fluids may be conveniently made by the polymerization of an alphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example the methods disclosed by U.S. Pat. No. 4,149,178 or U.S. Pat. No. 3,382,291 may be conveniently used herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487. All of the aforementioned patents are incorporated herein by reference in their entirety. The dimers of the $C_{14}$ to $C_{18}$ olefins are described in U.S. Pat. No. 4,218,330, also incorporated herein.

Other useful synthetic lubricating base stock oils such as silicon-based oil or esters of phosphorus containing acids may also be utilized. For examples of other synthetic lubricating base stocks are the seminal work "Synthetic Lubricants", Gunderson and Hart, Reinhold Publ. Corp., NY 1962, which is incorporated in its entirety.

In alkylated aromatic stocks, the alkyl substituents are typically alkyl groups of about 8 to 25 carbon atoms, usually from about 10 to 18 carbon atoms and up to about three such substituents may be present, as described for the alkyl benzenes in ACS Petroleum Chemistry Preprint 1053-1058, "Poly n-Alkylbenzene Compounds: A Class of Thermally Stable and Wide Liquid Range Fluids", Eapen et al, Phila. 1984. Tri-alkyl benzenes may be produced by the cyclodimerization of 1-alkynes of 8 to 12 carbon atoms as described in U.S. Pat. No. 5,055,626. Other alkylbenzenes are described in European Patent Application 168 534 and U.S. Pat. No. 4,658,072. Alkylbenzenes are used as lubricant basestocks, especially for low-temperature applications (arctic vehicle service and refrigeration oils) and in papermaking oils. They are commercially available from producers of linear alkylbenzenes (LABs) such as Vista Chem. Co., Huntsman Chemical Co., Chevron Chemical Co., and Nippon Oil Co. Linear alkylbenzenes typically have good low pour points and low temperature viscosities and VI values greater than about 100, together with good solvency for additives. Other alkylated aromatics which may be used when desirable are described, for example, in "Synthetic Lubricants and High Performance Functional Fluids", Dressler, H., chap 5, (R. L. Shubkin (Ed.)), Marcel Dekker, NY, 1993. Each of the aforementioned references is incorporated herein by reference in its entirety.

Other useful fluids of lubricating viscosity include non-conventional or unconventional base stocks that have been processed, preferably catalytically, or synthesized to provide high performance lubrication characteristics.

Non-conventional or unconventional base stocks/base oils include one or more of a mixture of base stock(s) derived from one or more Gas-to-Liquids (GTL) materials, as well as isomerate/isodewaxate base stock(s) derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks.

As used herein, the following terms have the indicated meanings:

(a) "wax" - hydrocarbonaceous material having a high pour point, typically existing as a solid at room temperature, i.e., at a temperature in the range from about 15° C. to 25° C., and consisting predominantly of paraffinic materials;

(b) "paraffinic" material: any saturated hydrocarbons, such as alkanes. Paraffinic materials may include linear alkanes, branched alkanes (iso-paraffins), cycloalkanes (cycloparaffins; mono-ring and/or multi-ring), and branched cycloalkanes;

(c) "hydroprocessing": a refining process in which a feedstock is heated with hydrogen at high temperature and under pressure, commonly in the presence of a catalyst, to remove and/or convert less desirable components and to produce an improved product;

(d) "hydrotreating": a catalytic hydrogenation process that converts sulfur- and/or nitrogen-containing hydrocarbons into hydrocarbon products with reduced sulfur and/or nitrogen content, and which generates hydrogen sulfide and/or ammonia (respectively) as byproducts; similarly, oxygen containing hydrocarbons can also be reduced to hydrocarbons and water;

(e) "catalytic dewaxing": a catalytic process in which normal paraffins (wax) and/or waxy hydrocarbons are converted by cracking/fragmentation into lower molecular weight species;

(f) "hydroisomerization" (or isomerization or isodewaxing): a catalytic process in which normal paraffins (wax) and/or slightly branched iso-paraffins are converted by rearrangement/isomerization into more branched iso-paraffins;

(g) "hydrocracking": a catalytic process in which hydrogenation accompanies the cracking/fragmentation of hydrocarbons, e.g., converting heavier hydrocarbons into lighter hydrocarbons, or converting aromatics and/or cycloparaffins (naphthenes) into non-cyclic branched paraffins;

(h) "hydrodewaxing"—a catalytic process in which normal paraffins (wax) and/or slightly branched iso-paraffins are converted by rearrangement/isomerization into more branched iso-paraffins and by cracking/fragmentation into lower molecular weight species.

The term "hydroisomerization-hydrodewaxing/catalytic dewaxing" is used to refer to one or more catalytic processes which have the combined effect of converting normal paraffins and/or waxy hydrocarbons by cracking/fragmentation into lower molecular weight species and, by rearrangement/isomerization, into more branched iso-paraffins. Such combined processes are sometimes described as "hydrodewaxing dewaxing" or "selective hydrocracking" or "isodewaxing".

GTL materials are materials that are derived via one or more synthesis, combination, transformation, rearrangement, and/or degradation/deconstructive processes from gaseous carbon-containing compounds, hydrogen-containing compounds, and/or elements as feedstocks such as hydrogen, carbon dioxide, carbon monoxide, water, methane, ethane, ethylene, acetylene, propane, propylene, propyne, butane, butylenes, and butynes. GTL base stocks and base oils are GTL materials of lubricating viscosity that are generally derived from hydrocarbons, for example waxy synthesized hydrocarbons, that are themselves derived from simpler gaseous carbon-containing compounds, hydrogen-containing compounds and/or elements as feedstocks. GTL base stock(s) include oils boiling in the lube oil boiling range separated/fractionated from GTL materials such as by, for example, distillation or thermal diffusion, and subsequently subjected to well-known catalytic or solvent dewaxing processes to produce lube oils of reduced/low pour point; wax isomerates, comprising, for example, hydroisomerized or isodewaxed synthesized hydrocarbons; hydroisomerized or isodewaxed Fischer-Tropsch (F-T) material (i.e., hydrocarbons, waxy hydrocarbons, waxes and possible analogous oxygenates); preferably hydroisomerized or isodewaxed F-T hydrocarbons or hydroisomerized or isodewaxed F-T waxes, hydroisomerized or isodewaxed synthesized waxes, or mixtures thereof.

GTL base stock(s) derived from GTL materials, especially, hydroisomerized/isodewaxed F-T material derived base stock(s), and other hydroisomerized/isodewaxed wax derived base stock(s) are characterized typically as having kinematic viscosities at 100° C. of from about 2 $mm^2/s$ to about 50 $mm^2/s$, preferably from about 3 $mm^2/s$ to about 50 $mm^2/s$, more preferably from about 3.5 $mm^2/s$ to about 30 $mm^2/s$, as exemplified by a GTL base stock derived by the isodewaxing of F-T wax, which has a kinematic viscosity of about 4 $mm^2/s$ at 100° C. and a viscosity index of about 130 or greater. Reference herein to Kinematic viscosity refers to a measurement made by ASTM method D445.

GTL base stocks and base oils derived from GTL materials, especially hydroisomerized/isodewaxed F-T material derived base stock(s), and other hydroisomerized/isodewaxed wax-derived base stock(s), such as wax hydroisomerates/isodewaxates, which can be used as base stock components of this invention are further characterized typically as having pour points of about −5° C. or lower, preferably about −10° C. or lower, more preferably about −15° C. or lower, still more preferably about −20° C. or lower, and under some conditions may have advantageous pour points of about −25° C. or lower, with useful pour points of about −30° C. to about −40° C. or lower. If necessary, a separate dewaxing step (catalytic dewaxing or solvent dewaxing) may be practiced on hydroisomerate to achieve the desired pour point. References herein to pour point refer to measurement made by ASTM D97 and similar automated versions.

The GTL base stock(s) derived from GTL materials, especially hydroisomerized/isodewaxed F-T material derived base stock(s), and other hydroisomerized/isodewaxed wax-derived base stock(s) which are base stock components which can be used in this invention are also characterized typically as having viscosity indices of 80 or greater, preferably 100 or greater, and more preferably 120 or greater. Additionally, in certain particular instances, viscosity index of these base stocks may be preferably 130 or greater, more preferably 135 or greater, and even more preferably 140 or greater. For example, GTL base stock(s) that derive from GTL materials preferably F-T materials especially F-T wax generally have a viscosity index of 130 or greater. References herein to viscosity index refer to ASTM method D2270.

In addition, the GTL base stock(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stocks and base oils typically have very low sulfur and nitrogen content, generally containing less than about 10 ppm, and more typically less than about 5 ppm of each of these elements. The sulfur and nitrogen content of GTL base stock and base oil obtained by the hydroisomerization/isodewaxing of F-T material, especially F-T wax is essentially nil.

In a preferred embodiment, the GTL base stock(s) comprises paraffinic materials that consist predominantly of non-cyclic isoparaffins and only minor amounts of cycloparaffins. These GTL base stock(s) typically comprise paraffinic materials that consist of greater than 60 wt % non-cyclic isoparaffins, preferably greater than 80 wt % non-cyclic isoparaffins, more preferably greater than 85 wt % non-cyclic isoparaffins, and most preferably greater than 90 wt % non-cyclic isoparaffins.

Useful compositions of GTL base stock(s), hydroisomerized or isode-waxed F-T material derived base stock(s), and wax-derived hydroisomerized/isodewaxed base stock(s), such as wax isomerates/isodewaxates, are recited in U.S. Pat. Nos. 6,080,301; 6,090,989, and 6,165,949 for example.

Isomerate/isodewaxate base stock(s), derived from waxy feeds, which are also suitable for use in this invention, are paraffinic fluids of lubricating viscosity derived from hydroisomerized or isodewaxed waxy feedstocks of mineral oil, non-mineral oil, non-petroleum, or natural source origin, e.g., feedstocks such as one or more of gas oils, slack wax, waxy fuels hydrocracker bottoms, hydrocarbon raffinates, natural waxes, hyrocrackates, thermal crackates, foots oil, wax from coal liquefaction or from shale oil, or other suitable mineral oil, non-mineral oil, non-petroleum, or natural source derived waxy materials, linear or branched hydrocarbyl compounds with carbon number of about 20 or greater, preferably about 30 or greater, and mixtures of such isomerate/isodewaxate base stocks and base oils.

Slack wax is the wax recovered from waxy hydrocarbon oils, e.g., petroleum oils by solvent or autorefrigerative dewaxing. Solvent dewaxing employs chilled solvent such as methyl ethyl ketone (MEK), methyl isobutyl ketone (MIBK), mixtures of MEK/MIBK, mixtures of MEK and toluene, while autorefrigerative dewaxing employs pressurized, liquefied low boiling hydrocarbons such as propane or butane.

Slack wax(es) secured from petroleum oils may contain sulfur and nitrogen containing compounds. Such heteroatom compounds must be removed by hydrotreating (and not hydrocracking), as for example by hydrodesulfurization (HDS) and hydrodenitrogenation (HDN) so as to avoid subsequent poisoning/deactivation of the hydroisomerization catalyst.

The term GTL base oil/base stock and/or wax isomerate base oil/base stock as used herein and in the claims is to be understood as embracing individual fractions of GTL base stock/base oil or wax isomerate base stock/base oil as recovered in the production process, mixtures of two or more GTL base stocks/base oil fractions and/or wax isomerate base stocks/base oil fractions, as well as mixtures of one or two or more low viscosity GTL base stock(s)/base oil fraction(s) and/or wax isomerate base stock(s)/base oil fraction(s) with one, two or more high viscosity GTL base stock(s)/base oil fraction(s) and/or wax isomerate base stock(s)/base oil fraction(s) to produce a dumbbell blend wherein the blend exhibits a viscosity within the aforesaid recited range.

In a preferred embodiment, the GTL material, from which the GTL base stock(s) is/are derived is an F-T material (i.e., hydrocarbons, waxy hydrocarbons, wax). A slurry F-T synthesis process may be beneficially used for synthesizing the feed from CO and hydrogen and particularly one employing an F-T catalyst comprising a catalytic cobalt component to provide a high alpha for producing the more desirable higher molecular weight paraffins. This process is also well known to those skilled in the art.

In an F-T synthesis process, a synthesis gas comprising a mixture of $H_2$ and CO is catalytically converted into hydrocarbons and preferably liquid hydrocarbons. The mole ratio of the hydrogen to the carbon monoxide may broadly range from about 0.5 to 4, but which is more typically within the range of from about 0.7 to 2.75 and preferably from about 0.7 to 2.5. As is well known, F-T synthesis processes include processes in which the catalyst is in the form of a fixed bed, a fluidized bed or as a slurry of catalyst particles in a hydrocarbon slurry liquid. The stoichiometric mole ratio for an F-T synthesis reaction is 2.0, but there are many reasons for using other than a stoichiometric ratio as those skilled in the art know. In cobalt slurry hydrocarbon synthesis process the feed mole ratio of the $H_2$ to CO is typically about 2.1/1. The synthesis gas comprising a mixture of $H_2$ and CO is bubbled up into the bottom of the slurry and reacts in the presence of the particulate F-T synthesis catalyst in the slurry liquid at conditions effective to form hydrocarbons, a portion of which are liquid at the reaction conditions and which comprise the hydrocarbon slurry liquid. The synthesized hydrocarbon liquid is separated from the catalyst particles as filtrate by means such as filtration, although other separation means such as centrifugation can be used. Some of the synthesized hydrocarbons pass out the top of the hydrocarbon synthesis reactor as vapor, along with unreacted synthesis gas and other gaseous reaction products. Some of these overhead hydrocarbon vapors are typically condensed to liquid and combined with the hydrocarbon liquid filtrate. Thus, the initial boiling point of the filtrate may vary depending on whether or not some of the condensed hydrocarbon vapors have been combined with it. Slurry hydrocarbon synthesis process conditions vary somewhat depending on the catalyst and desired products. Typical conditions effective to form hydrocarbons comprising mostly $C_{5+}$ paraffins, (e.g., $C_{5+}$-$C_{200}$) and preferably $C_{10+}$ paraffins, in a slurry hydrocarbon synthesis process employing a catalyst comprising a supported cobalt component include, for example, temperatures, pressures and hourly gas space velocities in the range of from about 320-850° F., 80-600 psi and 100-40,000 V/hr/V, expressed as standard volumes of the gaseous CO and $H_2$ mixture (0° C., 1 atm) per hour per volume of catalyst, respectively. The term "$C_{5+}$" is used herein to refer to hydrocarbons with a carbon number of greater than 4, but does not imply that material with carbon number 5 has to be present. Similarly other ranges quoted for carbon number do not imply that hydrocarbons having the limit values of the carbon number range have to be present, or that every carbon number in the quoted range is present. It is preferred that the hydrocarbon synthesis reaction be conducted under conditions in which limited or no water gas shift reaction occurs and more preferably with no water gas shift reaction occurring during the hydrocarbon synthesis. It is also preferred to conduct the reaction under conditions to achieve an alpha of at least 0.85, preferably at least 0.9 and more preferably at least 0.92, so as to synthesize more of the more desirable higher molecular weight hydrocarbons. This has been achieved in a slurry process using a catalyst containing a catalytic cobalt component. Those skilled in the art know that by alpha is meant the Schultz-Flory kinetic alpha. While suitable F-T reaction types of catalyst comprise, for example, one or more Group VIII catalytic metals such as Fe, Ni, Co, Ru and Re, it is preferred that the catalyst comprise a cobalt catalytic component. In one embodiment the catalyst comprises catalytically effective amounts of Co and one or more of Re, Ru, Fe, Ni, Th, Zr, Hf, U, Mg and La on a suitable inorganic support material, preferably one which comprises one or more refractory metal oxides. Preferred supports for Co containing catalysts comprise Titania, particularly. Useful catalysts and their preparation are known and illustrative, but nonlimiting examples may be found, for example, in U.S. Pat. Nos. 4,568,663; 4,663,305; 4,542,122; 4,621,072 and 5,545,674.

As set forth above, the waxy feed from which the base stock(s) is/are derived is wax or waxy feed from mineral oil, non-mineral oil, non-petroleum, or other natural source, especially slack wax, or GTL material, preferably F-T material, referred to as F-T wax. F-T wax preferably has an initial boiling point in the range of from 650-750° F. and preferably continuously boils up to an end point of at least 1050° F. A narrower cut waxy feed may also be used during the hydroisomerization. A portion of the n-paraffin waxy feed is converted to lower boiling isoparaffinic material. Hence, there must be sufficient heavy n-paraffin material to yield an isoparaffin containing isomerate boiling in the lube oil range. If catalytic dewaxing is also practiced after isomerization/isodewaxing, some of the isomerate/isodewaxate will also be hydrocracked to lower boiling material during the conventional catalytic dewaxing. Hence, it is preferred that the end boiling point of the waxy feed be above 1050° F. (1050° F.+).

When a boiling range is quoted herein it defines the lower and/or upper distillation temperature used to separate the fraction. Unless specifically stated (for example, by specifying that the fraction boils continuously or constitutes the entire range) the specification of a boiling range does not require any material at the specified limit has to be present, rather it excludes material boiling outside that range.

The waxy feed preferably comprises the entire 650-750° F.+ fraction formed by the hydrocarbon synthesis process, having an initial cut point between 650° F. and 750° F. determined by the practitioner and an end point, preferably above 1050° F., determined by the catalyst and process variables employed by the practitioner for the synthesis. Such fractions are referred to herein as "650-750° F.+ fractions". By contrast, "650-750° F.$^-$ fractions" refers to a fraction with an unspecified initial cut point and an end point somewhere between 650° F. and 750° F. Waxy feeds may be processed as the entire fraction or as subsets of the entire fraction prepared by distillation or other separation techniques. The waxy feed also typically comprises more than 90%, generally more than 95% and preferably more than 98 wt % paraffinic hydrocarbons, most of which are normal paraffins. It has negligible amounts of sulfur and nitrogen compounds (e.g., less than 1 wppm of each), with less than 2,000 wppm, preferably less than 1,000 wppm and more preferably less than 500 wppm of oxygen, in the form of oxygenates. Waxy feeds having these properties and useful in the process of the invention have been made using a slurry F-T process with a catalyst having a catalytic cobalt component, as previously indicated.

The process of making the lubricant oil base stocks from waxy stocks, e.g., slack wax or F-T wax, may be characterized as a hydrodewaxing process. If slack waxes are used as the feed, they may need to be subjected to a preliminary hydrotreating step under conditions already well known to those skilled in the art to reduce (to levels that would effectively avoid catalyst poisoning or deactivation) or to remove sulfur- and nitrogen-containing compounds which would otherwise deactivate the hydroisomerization/hydrodewaxing catalyst used in subsequent steps. If F-T waxes are used, such preliminary treatment is not required because, as indicated above, such waxes have only trace amounts (less than about 10 ppm, or more typically less than about 5 ppm to nil) of sulfur or nitrogen compound content. However, some hydrodewaxing catalyst fed F-T waxes may benefit from removal of oxygenates while others may benefit from oxygenates treatment. The hydrodewaxing process may be conducted over a combination of catalysts, or over a single catalyst. Conversion temperatures range from about 150° C. to about 500° C. at pressures ranging from about 500 to 20,000 kPa. This process may be operated in the presence of hydrogen, and hydrogen partial pressures range from about 600 to 6000 kPa. The ratio of hydrogen to the hydrocarbon feedstock (hydrogen circulation rate) typically range from about 10 to 3500 n.l.l.$^{-1}$ (56 to 19,660 SCF/bbl) and the space velocity of the feedstock typically ranges from about 0.1 to 20 LHSV, preferably 0.1 to 10 LHSV.

Following any needed hydrodenitrogenation or hydrodesulfurization, the hydroprocessing used for the production of base stocks from such waxy feeds may use an amorphous hydrocracking/hydroisomerization catalyst, such as a lube hydrocracking (LHDC) catalysts, for example catalysts containing Co, Mo, Ni, W, Mo, etc., on oxide supports, e.g., alumina, silica, silica/alumina, or a crystalline hydrocracking/hydroisomerization catalyst, preferably a zeolitic catalyst.

Other isomerization catalysts and processes for hydrocracking/hydroisomerized/isodewaxing GTL materials and/or waxy materials to base stock or base oil are described, for example, in U.S. Pat. Nos. 2,817,693; 4,900,407; 4,937,399; 4,975,177; 4,921,594; 5,200,382; 5,516,740; 5,182,248; 5,290,426; 5,580,442; 5,976,351; 5,935,417; 5,885,438; 5,965,475; 6,190,532; 6,375,830; 6,332,974; 6,103,099;

6,025,305; 6,080,301; 6,096,940; 6,620,312; 6,676,827; 6,383,366; 6,475,960; 5,059,299; 5,977,425; 5,935,416; 4,923,588; 5,158,671; and 4,897,178; EP 0324528 (B1), EP 0532116 (B1), EP 0532118 (B1), EP 0537815 (B1), EP 0583836 (B2), EP 0666894 (B2), EP 0668342 (B1), EP 0776959 (A3), WO 97/031693 (A1), WO 02/064710 (A2), WO 02/064711 (A1), WO 02/070627 (A2), WO 02/070629 (A1), WO 03/033320 (A1) as well as in British Patents 1,429,494; 1,350,257; 1,440,230; 1,390,359; WO 99/45085 and WO 99/20720. Particularly favorable processes are described in European Patent Applications 464546 and 464547. Processes using F-T wax feeds are described in U.S. Pat. Nos. 4,594,172; 4,943,672; 6,046,940; 6,475,960; 6,103,099; 6,332,974; and 6,375,830.

Hydrocarbon conversion catalysts useful in the conversion of the n-paraffin waxy feedstocks disclosed herein to form the isoparaffinic hydrocarbon base oil are zeolite catalysts, such as ZSM-5, ZSM-11, ZSM-23, ZSM-35, ZSM-12, ZSM-38, ZSM-48, offretite, ferrierite, zeolite beta, zeolite theta, and zeolite alpha, as disclosed in U.S. Pat. No. 4,906,350. These catalysts are used in combination with Group VIII metals, in particular palladium or platinum. The Group VIII metals may be incorporated into the zeolite catalysts by conventional techniques, such as ion exchange.

In one embodiment, conversion of the waxy feedstock may be conducted over a combination of Pt/zeolite beta and Pt/ZSM-23 catalysts in the presence of hydrogen. In another embodiment, the process of producing the lubricant oil base stocks comprises hydroisomerization/dewaxing over a single catalyst, such as Pt/ZSM-35. In yet another embodiment, the waxy feed can be fed over Group VIII metal loaded ZSM-48, preferably Group VIII noble metal loaded ZSM-48, more preferably Pt/ZSM-48 in either one stage or two stages. In any case, useful hydrocarbon base oil products may be obtained. Catalyst ZSM-48 is described in U.S. Pat. No. 5,075,269. The use of the Group VIII metal loaded ZSM-48 family of catalysts, preferably platinum on ZSM-48, in the hydroisomerization of the waxy feedstock eliminates the need for any subsequent, separate catalytic or solvent dewaxing step, and is preferred.

A separate dewaxing step, when needed, may be accomplished using either well known solvent or catalytic dewaxing processes and either the entire hydroisomerate or the 650-750° F.+ fraction may be dewaxed, depending on the intended use of the 650-750° F.− material present, if it has not been separated from the higher boiling material prior to the dewaxing. In solvent dewaxing, the hydroisomerate may be contacted with chilled solvents such as acetone, methyl ethyl ketone (MEK), methyl isobutyl ketone (MIBK), mixtures of MEK/MIBK, or mixtures of MEK/toluene and the like, and further chilled to precipitate out the higher pour point material as a waxy solid which is then separated from the solvent-containing lube oil fraction which is the raffinate. The raffinate is typically further chilled in scraped surface chillers to remove more wax solids. Low molecular weight hydrocarbons, such as propane, are also used for dewaxing, in which the hydroisomerate is mixed with liquid propane, a least a portion of which is flashed off to chill down the hydroisomerate to precipitate out the wax. The wax is separated from the raffinate by filtration, membrane separation or centrifugation. The solvent is then stripped out of the raffinate, which is then fractionated to produce the preferred base stocks useful in the present invention. Also well known is catalytic dewaxing, in which the hydroisomerate is reacted with hydrogen in the presence of a suitable dewaxing catalyst at conditions effective to lower the pour point of the hydroisomerate. Catalytic dewaxing also converts a portion of the hydroisomerate to lower boiling materials, in the boiling range, for example, 650-750° F.−, which are separated from the heavier 650-750° F.+ base stock fraction and the base stock fraction fractionated into two or more base stocks. Separation of the lower boiling material may be accomplished either prior to or during fractionation of the 650-750° F.+ material into the desired base stocks.

Any dewaxing catalyst which will reduce the pour point of the hydroisomerate and preferably those which provide a large yield of lube oil base stock from the hydroisomerate may be used. These include shape selective molecular sieves which, when combined with at least one catalytic metal component, have been demonstrated as useful for dewaxing petroleum oil fractions and include, for example, ferrierite, mordenite, ZSM-5, ZSM-11, ZSM-23, ZSM-35, ZSM-22 also known as theta one or TON, and the silicoaluminophosphates known as SAPO's. A dewaxing catalyst which has been found to be unexpectedly particularly effective comprises a noble metal, preferably Pt, composited with H-mordenite. The dewaxing may be accomplished with the catalyst in a fixed, fluid or slurry bed. Typical dewaxing conditions include a temperature in the range of from about 400-600° F., a pressure of 500-900 psig, $H_2$ treat rate of 1500-3500 SCF/B for flow-through reactors and LHSV of 0.1-10, preferably 0.2-2.0. The dewaxing is typically conducted to convert no more than 40 wt % and preferably no more than 30 wt % of the hydroisomerate having an initial boiling point in the range of 650-750° F. to material boiling below its initial boiling point.

GTL base stock(s), isomerized or isodewaxed wax-derived base stock(s), have a beneficial kinematic viscosity advantage over conventional Group II and Group III base stocks and base oils, and so may be very advantageously used with the instant invention. Such GTL base stocks and base oils can have significantly higher kinematic viscosities, up to about 20-50 $mm^2/s$ at 100° C., whereas by comparison commercial Group II base oils can have kinematic viscosities, up to about 15 $mm^2/s$ at 100° C., and commercial Group III base oils can have kinematic viscosities, up to about 10 $mm^2/s$ at 100° C. The higher kinematic viscosity range of GTL base stocks and base oils, compared to the more limited kinematic viscosity range of Group II and Group III base stocks and base oils, in combination with the instant invention can provide additional beneficial advantages in formulating lubricant compositions.

In the present invention the one or more isomerate/isodewaxate base stock(s), the GTL base stock(s), or mixtures thereof, preferably GTL base stock(s) can constitute all or part of the base oil.

One or more of the wax isomerate/isodewaxate base stocks and base oils can be used as such or in combination with the GTL base stocks and base oils.

One or more of these waxy feed derived base stocks and base oils, derived from GTL materials and/or other waxy feed materials can similarly be used as such or further in combination with other base stocks and base oils of mineral oil origin, natural oils and/or with synthetic base oils.

The preferred base stocks or base oils derived from GTL materials and/or from waxy feeds are characterized as having predominantly paraffinic compositions and are further characterized as having high saturates levels, low-to-nil sulfur, low-to-nil nitrogen, low-to-nil aromatics, and are essentially water-white in color.

The GTL base stock/base oil and/or wax hydroisomerate/isodewaxate, preferably GTL base oils/base stocks obtained from F-T wax, more preferably GTL base oils/base stocks obtained by the hydroisomerization/isodewaxing of F-T wax, can constitute from about 5 to 100 wt %, preferably between about 20 to 40 to up to 100 wt %, more preferably about 70 to 100 wt % of the total of the base oil, the amount employed being left to the practitioner in response to the requirements of the finished lubricant.

A preferred GTL liquid hydrocarbon composition is one comprising paraffinic hydrocarbon components in which the extent of branching, as measured by the percentage of methyl hydrogens (BI), and the proximity of branching, as measured by the percentage of recurring methylene carbons which are four or more carbons removed from an end group or branch ($CH_2 \geqq 4$), are such that: (a) $BI-0.5(CH_2 \geqq 4)>15$; and (b) $BI+0.85(CH_2 \geqq 4)<45$ as measured over said liquid hydrocarbon composition as a whole.

The preferred GTL base oil can be further characterized, if necessary, as having less than 0.1 wt % aromatic hydrocarbons, less than 20 wppm nitrogen containing compounds, less than 20 wppm sulfur containing compounds, a pour point of less than −18° C., preferably less than −30° C., a preferred $BI \geqq 25.4$ and $(CH_2 \geqq 4) \leqq 22.5$. They have a nominal boiling point of 370° C.$^+$, on average they average fewer than 10 hexyl or longer branches per 100 carbon atoms and on average have more than 16 methyl branches per 100 carbon atoms. They also can be characterized by a combination of dynamic viscosity, as measured by CCS at −40° C., and kinematic viscosity, as measured at 100° C. represented by the formula: DV (at −40° C.)<2900 (KV @ 100° C.)−7000.

The preferred GTL base oil is also characterized as comprising a mixture of branched paraffins characterized in that the lubricant base oil contains at least 90% of a mixture of branched paraffins, wherein said branched paraffins are paraffins having a carbon chain length of about $C_{20}$ to about $C_{40}$, a molecular weight of about 280 to about 562, a boiling range of about 650° F. to about 1050° F., and wherein said branched paraffins contain up to four alkyl branches and wherein the free carbon index of said branched paraffins is at least about 3.

In the above the Branching Index (BI), Branching Proximity ($CH_2 \geqq 4$), and Free Carbon Index (FCI) are determined as follows:

Branching Index

A 359.88 MHz 1 H solution NMR spectrum is obtained on a Bruker 360 MHz AMX spectrometer using 10% solutions in $CDCl_3$. TMS is the internal chemical shift reference. $CDCl_3$ solvent gives a peak located at 7.28. All spectra are obtained under quantitative conditions using 90 degree pulse (10.9 μs), a pulse delay time of 30 s, which is at least five times the longest hydrogen spin-lattice relaxation time ($T_1$), and 120 scans to ensure good signal-to-noise ratios.

H atom types are defined according to the following regions:

9.2-6.2 ppm hydrogens on aromatic rings;

6.2-4.0 ppm hydrogens on olefinic carbon atoms;

4.0-2.1 ppm benzylic hydrogens at the α-position to aromatic rings;

2.1-1.4 ppm paraffinic CH methine hydrogens;

1.4-1.05 ppm paraffinic $CH_2$ methylene hydrogens;

1.05-0.5 ppm paraffinic $CH_3$ methyl hydrogens.

The branching index (BI) is calculated as the ratio in percent of non-benzylic methyl hydrogens in the range of 0.5 to 1.05 ppm, to the total non-benzylic aliphatic hydrogens in the range of 0.5 to 2.1 ppm.

Branching Proximity ($CH_2 \geqq 4$)

A 90.5 MHz$^3$CMR single pulse and 135 Distortionless Enhancement by Polarization Transfer (DEPT) NMR spectra are obtained on a Brucker 360 MHzAMX spectrometer using 10% solutions in $CDCL_3$. TMS is the internal chemical shift reference. $CDCL_3$ solvent gives a triplet located at 77.23 ppm in the $^{13}C$ spectrum. All single pulse spectra are obtained under quantitative conditions using 45 degree pulses (6.3 μs), a pulse delay time of 60 s, which is at least five times the longest carbon spin-lattice relaxation time ($T_1$), to ensure complete relaxation of the sample, 200 scans to ensure good signal-to-noise ratios, and WALTZ-16 proton decoupling.

The C atom types $CH_3$, $CH_2$, and CH are identified from the 135 DEPT $^{13}C$ NMR experiment. A major $CH_2$ resonance in all $^{13}C$ NMR spectra at ≈29.8 ppm is due to equivalent recurring methylene carbons which are four or more removed from an end group or branch (CH2>4). The types of branches are determined based primarily on the $^{13}C$ chemical shifts for the methyl carbon at the end of the branch or the methylene carbon one removed from the methyl on the branch.

Free Carbon Index (FCI). The FCI is expressed in units of carbons, and is a measure of the number of carbons in an isoparaffin that are located at least 5 carbons from a terminal carbon and 4 carbons way from a side chain. Counting the terminal methyl or branch carbon as "one" the carbons in the FCI are the fifth or greater carbons from either a straight chain terminal methyl or from a branch methane carbon. These carbons appear between 29.9 ppm and 29.6 ppm in the carbon-13 spectrum. They are measured as follows:

a. calculate the average carbon number of the molecules in the sample which is accomplished with sufficient accuracy for lubricating oil materials by simply dividing the molecular weight of the sample oil by 14 (the formula weight of $CH_2$);

b. divide the total carbon-13 integral area (chart divisions or area counts) by the average carbon number from step a. to obtain the integral area per carbon in the sample;

c. measure the area between 29.9 ppm and 29.6 ppm in the sample; and d. divide by the integral area per carbon from step b. to obtain FCI.

Branching measurements can be performed using any Fourier Transform NMR spectrometer. Preferably, the measurements are performed using a spectrometer having a magnet of 7.0T or greater. In all cases, after verification by Mass Spectrometry, UV or an NMR survey that aromatic carbons were absent, the spectral width was limited to the saturated carbon region, about 0-80 ppm vs. TMS (tetramethylsilane). Solutions of 15-25 percent by weight in chloroform-d1 were excited by 45 degrees pulses followed by a 0.8 sec acquisition time. In order to minimize non-uniform intensity data, the proton decoupler was gated off during a 10 sec delay prior to the excitation pulse and on during acquisition. Total experiment times ranged from 11-80 minutes. The DEPT and APT sequences were carried out according to literature descriptions with minor deviations described in the Varian or Bruker operating manuals.

DEPT is Distortionless Enhancement by Polarization Transfer. DEPT does not show quaternaries. The DEPT 45 sequence gives a signal for all carbons bonded to protons. DEPT 90 shows CH carbons only. DEPT 135 shows CH and $CH_3$ up and $CH_2$ 180 degrees out of phase (down). APT is Attached Proton Test. It allows all carbons to be seen, but if CH and $CH_3$ are up, then quaternaries and $CH_2$ are down. The sequences are useful in that every branch methyl should have a corresponding CH. And the methyls are clearly identified by chemical shift and phase. The branching properties of each sample are determined by C-13 NMR using the assumption in the calculations that the entire sample is isoparaffinic. Corrections are not made for n-paraffins or cycloparaffins, which may be present in the oil samples in varying amounts. The cycloparaffins content is measured using Field Ionization Mass Spectroscopy (FIMS).

GTL base oils and base oils derived from synthesized hydrocarbons, for example, hydroisomerized or isodewaxed waxy synthesized hydrocarbon, e.g., F-T waxy hydrocarbon base oils are of low or zero sulfur and phosphorus content. There is a movement among original equipment manufacturers and oil formulators to produce formulated oils of ever increasingly reduced sulfur, sulfated ash and phosphorus content to meet ever increasingly restrictive environmental regulations. Such oils, known as low SAP oils, would rely on the use of base oils which themselves, inherently, are of low or zero initial sulfur and phosphorus content. Such oils when used as base oils can be formulated with low ash additives and even if the additive or additives contain sulfur and/or phosphorus the resulting formulated oils will be lower or low SAP.

Low SAP formulated oils for vehicle engines (both spark ignited and compression ignited) will have a sulfur content of 0.7 wt % or less, preferably 0.6 wt % or less, more preferably 0.5 wt % or less, most preferably 0.4 wt % or less, an ash content of 1.2 wt % or less, preferably 0.8 wt % or less, more preferably 0.4 wt % or less, and a phosphorus content of 0.18% or less, preferably 0.1 wt % or less, more preferably 0.09 wt % or less, most preferably 0.08 wt % or less, and in certain instances, even preferably 0.05 wt % or less.

Alkylene oxide polymers and interpolymers and their derivatives containing modified terminal hydroxyl groups obtained by, for example, esterification or etherification are useful synthetic lubricating oils. By way of example, these oils may be obtained by polymerization of ethylene oxide or propylene oxide, the alkyl and aryl ethers of these polyoxyalkylene polymers (methyl-polyisopropylene glycol ether having an average molecular weight of about 1000, diphenyl ether of polyethylene glycol having a molecular weight of about 500-1000, and the diethyl ether of polypropylene glycol having a molecular weight of about 1000 to 1500, for example) or mono- and polycarboxylic esters thereof (the acidic acid esters, mixed $C_{3-8}$ fatty acid esters, or the $C_{13}$Oxo acid diester of tetraethylene glycol, for example).

Esters comprise a useful base stock. Additive solvency and seal compatibility characteristics may be secured by the use of esters such as the esters of dibasic acids with monoalkanols and the polyol esters of monocarboxylic acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those which are obtained by reacting one or more polyhydric alcohols (preferably the hindered polyols such as the neopentyl polyols e.g. neopentyl glycol, trimethylol ethane, 2-methyl-2-propyl-1,3-propanediol, trimethylol propane, pentaerythritol and dipentaerythritol) with alkanoic acids containing at least about 4 carbon atoms (preferably $C_5$ to $C_{30}$ acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid).

Suitable synthetic ester components include the esters of trimethylol propane, trimethylol butane, trimethylol ethane, pentaerythritol and/or dipentaerythritol with one or more monocarboxylic acids containing from about 5 to about 10 carbon atoms.

Silicon-based oils are another class of useful synthetic lubricating oils. These oils include polyalkyl-, polyaryl-, polyalkoxy-, and polyaryloxy-siloxane oils and silicate oils. Examples of suitable silicon-based oils include tetraethyl silicate, tetraisopropyl silicate, tetra-(2-ethylhexyl)silicate, tetra-(4-methylhexyl) silicate, tetra-(p-tert-butylphenyl) silicate, hexyl-(4-methyl-2-pentoxy) disiloxane, poly(methyl) siloxanes, and poly-(methyl-2-mehtylphenyl) siloxanes.

Another class of synthetic lubricating oil is esters of phosphorous-containing acids. These include, for example, tricresyl phosphate, trioctyl phosphate, diethyl ester of decane-phosphonic acid.

Another class of oils includes polymeric tetrahydrofurans, their derivatives, and the like.

Other useful fluids of lubricating viscosity include non-conventional or unconventional base stocks that have been processed, preferably catalytically, or synthesized to provide high performance lubrication characteristics.

In many cases it will be advantageous to employ only a GTL base stock such as one derived from waxy Fischer-Tropsch hydrocarbons for a particular wear resistant lubricant, while in other cases one or more additional base stocks may be mixed with, added to or blended with one or more of the GTL base stocks, e.g., Fischer-Tropsch derived base stocks. Such additional base stocks may be selected from the group consisting of (i) natural base stock, (ii) synthetic base stock, (iii) unconventional base stock and mixtures thereof.

If a base stock blend is used it should contain at least 20 wt %, preferably at least 40 wt %, more preferably at least 60 wt %, most preferably at least 80 wt % of the GTL base stock or base oil, or slack wax or Fischer-Tropsch derived base stock, preferably Fischer-Tropsch derived base stock. As is readily apparent, any formulated oil utilizing such a blend while exhibiting performance superior to that secured when such other base stock is used exclusively will be inferior in performance to that achieved when GTL base stocks, Fischer-Tropsch derived base stock or mixture thereof is the only base stock employed.

Advantage can be taken of the present invention in formulating low sulfur, low ash and low phosphorus lubricating oil compositions to met the latest lubricant requirements of the OEM's.

EXAMPLES

Example 1

(a) Primene 81R Salicylate: A stoichiometric quantity of salicylic acid (Aldrich) was added slowly to a heated (50° C.) and stirred solution of Primene 81R a $C_{12}$-$C_{14}$ tertiary amine (Rohm & Haas). The temperature kept rising to 105° C. due to the exothermic reaction of acid-base neutralization. The temperature was then raised to 126° C. for 1 hour. A bright yellow solution was formed upon cooling.

(b) Primene 81R-Oxyoctadecyl salicylate: Same procedure as in (a) except that the final temperature was increased to 135° C. for 1 hour.

(c) Primene 81R 5-Octyldecyl salicylate: Same as procedure (b).

(d) Thiadiazole salicylic acid, thiadiazole 5-Oxyoctyldecyl salicylate, thiadiazole 5-Octyldecyl salicylate: same as procedure (b).

At 105° C., the products were the salts of salicylic acid. At temperatures above 120° C., the products were the amides of the acids used.

All above additives were also borated with $B(OH)_3$. The total amount of boron added to each molecule ranged between 50-1000 ppm.

Example 2

This example shows the excellent performance of Primene 81R salicylate and other derivatives in bench tests.

(a) TEOST 33C Test: TEOST, Thermo-Oxidation Engine Oil Simulation Test is an ASTM bench test (D 6335) designed to predict high temperature turbocharger deposit.

TABLE 1

TEOST Deposits for Primene 81R Salicylate

| Additive in 0.05 wt % Phosphorus Oil,[a] wt % | Deposits, mg |
|---|---|
| 0.0[1] | 27.8 |
| 1.0[1] | 8.4 |
| 2.0[2] | 12.8 |
| 3.0[2] | 9.7 |

[a]phosphorus from ZDDP

[1]fully formulated 5 W 30 oil containing 2 wt % conventional metal detergent plus conventional additives

[2]same as (1) but less the 2 wt % metal detergent replaced by indicated amount of ashless Primene 81R Salicylate detergent.

These results indicate that the addition of amine salicylate to a 5W30 formulated oil without metal detergent significantly reduced deposit formation by an average of 63%) in this test.

(b) Total Base Number Evaluation:

Alkalinity reserve in formulated oil is critical for extended drain performance. Amine salicylate appears to provide additional TBN to the oil as shown below.

TABLE 2

TBN Analysis of Primene 81R Salicylate

| Additive, wt % | 9.9 | 1.0 | 2.0 |
|---|---|---|---|
| TBN, mg KOH/g Oil | | | |
| In Base Oil | 0.0 | 1.5 | 3.0 |
| In 0.05 wt % Phosphorus 5W30 Oil | 1.0 | 2.9 | 5.2 |

TBN = Total Base Number of oils measured by ASTM D4739 (HCl titration)

(c) Antiwear and Antioxidant Capabilities:

Amine salicylate shows hydroperoxide decomposing capability and possible synergism with antiwear additive ZDDP as shown below:

TABLE 3

Four Ball Wear Results (ASTM D4172) for Primene 81R Salicylate

| Test Conditions 60 kg, 1200 rpm, 100° C., 60 mins. | 0.0 wt % Phosphorus Oil Wear Scar Diameter (mm) | | 0.05 wt % Phosphorus Oil Wear Scar Diameter (mm) | |
|---|---|---|---|---|
| Additive, wt % | No t-BHP | 90 mmol t-BHP/1000/g | No t-BHP | 90 mmol t-BHP/1000/g |
| 0.0 | 1.51 | 1.51 | 0.64 | 1.54 |
| 0.5 | 1.48 | 1.14 | 0.48 | 1.02 |
| 1 | 0.39 | 0.65 | 0.43 | 0.59 |
| 2 | 0.66 | 0.51 | 0.42 | 0.48 |

The wear scar diameter results for an oil containing just the ZDDP and no Primene 81R salicylate or other detergent (metal) or ZDDP and metal detergent was found to be 0.64 mm in both instances.

(d) Thin Film Oxidation Test (TFO):

TFO is another bench deposit test (3 hours, 630° F., 2500 rpm, oil flow 245 cc/min, and airflow 200 L/min), that relate well to the VWTDi2 (CEC L-78-T-99) piston deposit test. This test is described in SAE 85 1797. Results show that amine salicylate, amine 5-octyldecyl salicylate and their borated derivatives are good ashless detergents:

TABLE 4

| | TFO Cleanliness Rating (Merit Scale)* |
|---|---|
| Formulated Oils with Salicylate | |
| 2.5 wt % Primene 81R Salicylate | 70 |
| 2.5 wt % Calcium Salicylate | 71 |
| 1.25 wt % Primene 81R Salicylate and 1.25 wt % Calcium Salicylate | 90 |
| 1.25 wt % Primene 81R Salicylate (Borated) and 1.25 wt % Calcium Salicylate | 89 |
| Formulated Oils with Alkylated Salicylate | |
| 2.5 wt % Primene 81R:5-Octyldecyl Salicylate (Borated) | 70 |
| 1.25 wt % Primene 81R:5-Octyldecyl Salicylate and 1.25 wt % Calcium Salicylate | 91 |
| 1.25 wt % Primene 81R:5-Octyldecyl Salicylate (Borated) and 1.25 wt % Calcium Salicylate | 90 |

*Higher number means cleaner.

(e) VW T Di2 (CEC L-78-T-99) Piston Deposit Test:

Prime 81R salicylate and its borated derivative and Primene 81R 5-octyldecyl salicylate were evaluated in this bench engine test. Results show that this class of ashless additives can also perform well in a fired bench engine test:

TABLE 5

| Blend Code | Primene 81R Salicylate | Primene 81R Salicylate (borated) | Primene 81R: 5-octyldecyl salicylate | Primene 81R 5-octyldecyl salicylate (benated) |
|---|---|---|---|---|
| KV at 100° C. (ASTM D445), cSt | 11.9 | 12.0 | 11.61 | 11.60 |

TABLE 5-continued

| Blend Code | Primene 81R Salicylate | Primene 81R Salicylate (borated) | Primene 81R: 5-octyldecyl salicylate | Primene 81R 5-octyldecyl salicylate (benated) |
|---|---|---|---|---|
| TBN (ASTM D2896), mg KOH/g oil | 5.65 | 5.67 | 6.11 | 5.98 |
| Boron (ASTM D4951), wt % | 0.02 | 0.03 | 0.03 | 0.03 |
| TFO (3 hours, 630° F., 2500 rpm, oil flow 245 cc/min, air flow 200 L/min), cleanliness rating | 70 | 89 | 91 | 90 |
| VWTDi2 Piston Deposit Test (Rating 0–100, where 100 is clean, ≧60 is a pass) | 41 | 51 | 60 | 64 |

Example 3

Thiadiazole (Vanlube 871) derivatives of salicylic acid and 5-oxy actyldecyl salicylic acid showed good performance in the TFO test (oils 1 and 2) when used as a replacement for 50% of the detergent in a fully formulated 5 W 30 oil containing 0.08 wt % P (reference Oil 3). The TFO results are presented in Table 6.

TABLE 6

Thin Film Oxidation Test

| Oil | Condition 1 (Mild), Rating | Condition 2 (Severe), Rating |
|---|---|---|
| Thiadiazole salicylate (Oil 1) | 89 | 64 |
| Thiadiazole, 5-Oxysalicylate (Oil 2) | 89 | 62 |
| Reference Oil (Oil 3) | 83 | 48 |

Condition 1 = Oil preheat 540° F., Disk temperature 615° F., Duration 85 minutes.

Condition 2 = Oil preheat 550° F., Disk temperature 630° F., Duration 180 minutes.

Oil 1 = 50% thiadaizole salicylate + 50% metal detergent in 5W30 (Reference Oil 3).

Oil 2 = 50% thiadaizole 5-Oxyoctyldecyl salicylate + 50% metal detergent in 5W30 (Reference Oil 3).

Reference Oil 3 = 5W30 fully formulated oil.

Thiadiazole salicylic acid derivatives also showed significant hydroperoxide decomposition capability relative to the reference oil, which contains ZDDP as the main source of hydroperoxide decomposition in the oil. As shown in Table 7, the decomposition ratio of ZDDP:t-butyl hydroperoxide (t-BHP) in the reference oil is 1:3, which is in a very good agreement with literature values. Addition of the thiadiazole derivatives to the oils more than doubled this ratio.

The oils were examined by carbon-13 nuclear magnetic resonance (NMR) spectroscopy on a JEOL GSX-400 NMR spectrometer at Larmor frequency of 100 megahertz. The sample temperatures were varied in situ over a range of 27° C. and 68° C. Between 200 and 350 transients were acquired for each spectrum, with a 90 degree pulse on the carbon nucleus, and inverse-gated proton decoupling. A spectrum was acquired at 27° C., to measure the initial relative concentrations of t-butyl hydroperoxide and t-butyl alcohol. Subsequently, the temperature was raised to 65° C., and maintained at this temperature for 240 minutes. Spectra were acquired periodically, and the decomposition of t-butyl hydroperoxide was monitored by comparing the oxygen-bonded carbon resonances for the hydroperoxide and the alcohol.

TABLE 7

Hydroperoxide Decomposition

| Oil | Additive concentration + ZDDP in mmole | Initial tert-Butyl Hydroperoxide, mmole | Final tert-Butyl Hydroperoxide, mmole |
|---|---|---|---|
| Thiadiazole salicylate (Oil 1) | 123 + 22 | 200 | 7 |
| Thiadiazole salicylate (Oil 1) | 35 + 22 | 200 | 28 |
| Thiadiazole, 5-Oxysalicylate (Oil 2) | 35 + 22 | 200 | 63 |
| Reference Oil (3) | 22 (ZDDP) | 200 | 134 |

What is claimed is:

1. An ashless detergent consisting of the borated reaction product of an amine of the formula:

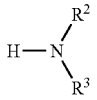

wherein $R^2$ and $R^3$ are the same or different and are hydrogen, $C_1$-$C_{20}$ alkyl, $C_2$-$C_{20}$ alkenyl, $C_6$-$C_{20}$ cycloalkyl, aryl, aryl alkyl or alky aryl, provided that $R^2$ and $R^3$ cannot both be hydrogen, with a salicylic acid.

2. An ashless detergent consisting of the borated reaction product of an amine with a sulfonic acid.

3. An ashless detergent consisting of the reaction product of a thiadiazole with a salicylic acid and borated derivatives thereof.

4. An ashless detergent consisting of the berated reaction product of a thiadiazole with a sulfonic acid.

5. The ashless detergent of claim 1, 2, 3 or 4 wherein the reaction product is a salt.

6. The ashless detergent of claim 1 or 2 wherein the amine reactant is an organic group substituted primary or secondary amine.

7. The ashless detergent of claim 6 wherein the amine reactant is an alkyl substituted primary or secondary amine.

8. The ashless detergent of claim 7 wherein the amine reactant is a $C_4$-$C_{20}$ tertiary alkyl group substituted primary or secondary amine.

9. The ashless detergent of claim 1 or 3 wherein the salicylic acid is an organic group substituted salicylic acid.

10. The ashless detergent of claim 9 wherein the salicylic acid is a $C_1$-$C_{40}$ alkyl, $C_2$-$C_{40}$ alkenyl, $C_6$-$C_{40}$ cycloalkyl, arylalkyl, alkylaryl, aryl, heteroatom substituted $C_1$-$C_{40}$ alkyl, $C_2$-$C_{40}$ alkenyl, $C_6$-$C_{40}$ cycloalkyl, arylalkyl, alkylaryl, aryl.

11. The ashless detergent of claim 10 wherein the salicylic acid is a $C_{10}$-$C_{20}$ alkyl, alkenyl, cycloalkyl, aryl, arylalkyl, alkylaryl and hcteroatom substituted derivative thereof substituted salicylic acid.

12. The ashless detergent of claim 3 or 4 wherein the thiadiazole is an organic group substituted thiadiazole.

13. The ashless detergent of claim 12 wherein the thiadiazole is a $C_1$-$C_{40}$ alkyl, $C_2$-$C_{40}$ alkenyl, $C_6$-$C_{40}$ cycloalkyl, arylalkyl, alkylaryl, aryl, heteroatom substituted $C_1$-$C_{40}$ alkyl, $C_2$-$C_{40}$ alkenyl, $C_6$-$C_{40}$ cycloalkyl, aryl, arylalkyl, alkylaryl substituted thiadiazole.

14. The ashless detergent of claim 13 wherein the thiadiazole is a $C_{10}$-$C_{30}$ alkyl, alkenyl, cycloalkyl, aryl, arylalkyl, alkylaryl and heteroatom substituted derivative thereof substituted thiadiazole.

15. The ashless detergent of claim 2 or 4 wherein the sulfonic acid is an organic group substituted sulfonic acid.

16. The ashless detergent of claim 15 wherein the organic group substituted sulfonic acid is $C_1$-$C_{10}$ alkyl, $C_2$-$C_{10}$ alkenyl, $C_{-6}$-$C_{10}$ cycloalkyl, aryl, alkylaryl, arylalkyl and heteroatom substituted derivatives thereof, $NH_2$, OH substituted sulfonic acid.

17. A low ash lubricating oil formulation comprising a major amount of a base oil of lubricating oil viscosity and a minor additive amount of at least one detergent selected from (1) an ashless detergent consisting of the borated reaction product of an amine of the formula;

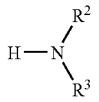

wherein $R^2$ and $R^3$ are the same or different and are hydrogen, $C_1$-$C_{20}$ alkyl, $C_2$-$C_{20}$ alkenyl, $C_6$-$C_{20}$ cycloalkyl, aryl, arylalkyl or alkylaryl provided that $R^2$ and $R^3$ cannot both or hydrogen with a salicylic acid; (2) an ashless detergent consisting of the borated reaction product of an amine with a sulfonic acid; (3) an ashless detergent consisting of the reaction product of a thiadiazole with a salicylic acid and borated derivative thereof;

and (4) an ashless detergent consisting of the borated reaction product of a thiadiazole with a sulfonic acid.

18. The low ash lubricating oil formulation of claim 17 wherein the reaction product comprising the ashless detergent is a salt.

19. The low ash lubricating oil formulation of claim 17 wherein the ashless detergent is present in an amount in the range of about 0.01 to about 8.0 wt % (active ingredient) based on the total weight of the lubricating oil formulation.

20. The low ash lubricating oil formulation of claim 18 wherein the ashless detergent is present in an amount in the range of about 0.01 to about 8.0 wt % (active ingredient) based on the total weight of the lubricating oil formulation.

21. The low ash lubricating oil formulation of claim 17, 18, 19 or 20 wherein the amine reactant is an organic substituted primary or secondary amine, the salicylic acid is an organic substituted salicylic acid, the thiadiazole is an organic substituted thiadiazole, the sulfonic acid is an organic substituted sulfonic acid.

22. The low ash lubricating oil formulation of claim 17, 18, 19 or 20 further containing at least one additional performance enhancing additive selected from detergent, dispersant, antioxidant, pour point depressant, viscosity index improver, anti wear agent, extreme pressure additive, friction modifier, demulsifier, antifoarnant, antiseizure agent, corrosion inhibitor, lubricity agent, seal swell content agent, dye, metal deactivator, antistaining agent.

23. The low ash lubricating oil formulation of claim 17, 18, 19 or 20 wherein the base oil of lubricating viscosity is selected from the group consisting of GTL base stock, wax isomcrate base oil and mixtures thereof.

24. The low ash lubricating oil formulation of claim 23 wherein the base oil of lubricating viscosity is a GTL base stock.

25. A method for improving the antiwear performance of a lubricating oil formulation measured by ASTM D4172 comprising adding to a lubricating base oil of lubricating oil viscosity an additive amount of an additive comprising a combination of the reaction product of an amine of the formula:

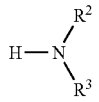

wherein $R^2$ and $R^3$ arc the same or different and are hydrogen, $C_1$-$C_{20}$ alkyl, $C_2$-$C_{20}$ alkenyl, $C_6$-$C_{20}$ cycloalkyl, aryl, arylalkyl or alkyaryl provided that $R^2$ and $R^3$ cannot both be hydrogen with a salicylic acid or borated derivative thereof, and ZDDP.

26. A method of improving the cleanliness of a lubricating oil formulation measured by the Thin Film Oxidation Test comprising adding to a lubricating base oil of lubricating oil viscosity an additive amount of an additive comprising a combination of an ashless detergent which is the reaction product of an amine of the formula:

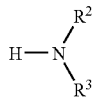

wherein $R^2$ and $R^3$ are the same or different and are hydrogen, $C_1$-$C_{20}$ alkyl, $C_2$-$C_{20}$ alkenyl, $C_6$-$C_{20}$ cycloalkyl, aryl, arylalkyl or alkyaryl provided that $R^2$ and $R^3$ cannot both he hydrogen with a salicylic acid or borated derivative thereof, and a detergent.

27. A method of improving the cleanliness of a lubricating oil formulation measured by the Thin Film Oxidation Test comprising adding to a lubricatingbase oil of lubricating oil viscosity an additive amount of an additive comprising a combination of an ashless detergent wherein the ashless detergent in is the reaction product of an amine substituted with a $C_4$-$C_{20}$ tertiary alkyl group with a salicylic acid or borated derivative thereof, and the a detergent which is calcium salicylate.

* * * * *